US009297158B2

(12) United States Patent
Lundmark et al.

(10) Patent No.: US 9,297,158 B2
(45) Date of Patent: Mar. 29, 2016

(54) STRUCTURAL SHEARWALL

(71) Applicant: Green Valley Corporation, San Jose, CA (US)

(72) Inventors: Bo J. Lundmark, Long Beach, CA (US); Clifford B. Swenson, San Jose, CA (US); Don R. Peoples, Milpitas, CA (US); Hardip S. Pannu, Moraga, CA (US)

(73) Assignee: Green Valley Corporation, San Jose, CA (US)

( * ) Notice: Subject to any disclaimer, the term of this patent is extended or adjusted under 35 U.S.C. 154(b) by 0 days.

(21) Appl. No.: 13/707,417

(22) Filed: Dec. 6, 2012

(65) Prior Publication Data

US 2013/0199112 A1 Aug. 8, 2013

Related U.S. Application Data

(63) Continuation of application No. 12/568,614, filed on Sep. 28, 2009, now abandoned.

(60) Provisional application No. 61/100,600, filed on Sep. 26, 2008, provisional application No. 61/151,126, filed on Feb. 9, 2009.

(51) Int. Cl.

| | |
|---|---|
| ***E04C 5/08*** | (2006.01) |
| ***E04H 1/00*** | (2006.01) |
| ***E04B 1/00*** | (2006.01) |
| ***E04B 1/20*** | (2006.01) |
| ***E04H 9/02*** | (2006.01) |
| *E04B 1/24* | (2006.01) |

(Continued)

(52) U.S. Cl.

CPC .. *E04B 1/20* (2013.01); *E04H 9/02* (2013.01); *E04B 2001/2496* (2013.01); *E04B 2001/2696* (2013.01); *E04H 1/04* (2013.01)

(58) Field of Classification Search

CPC ..... E04H 1/04; E04H 9/02; E04H 1/06; E04H 9/021; E04B 1/04; E04B 1/34823; E04B 2001/2484; E04B 5/43; E04B 1/20; E04B 2001/2496; E04B 2001/2696; E04B 1/164; E04B 2001/2448; E04B 2001/2472; E04B 2001/268; E04C 5/0645; E04F 11/02

USPC ..... 52/236.5, 236.9, 236.7, 236.8, 238.1, 52/243, 43, 236.3, 236.4, 234, 745.17, 52/262, 264, 251, 252, 745.18, 266

See application file for complete search history.

(56) References Cited

U.S. PATENT DOCUMENTS

| | | | | |
|---|---|---|---|---|
| 1,501,288 | A * | 7/1924 | Morley | 52/236.8 |
| 3,659,387 | A * | 5/1972 | Pearson, Jr. | 52/30 |
| 3,720,034 | A | 3/1973 | Dawley | |

(Continued)

FOREIGN PATENT DOCUMENTS

| | | |
|---|---|---|
| WO | WO 2000023666 | 4/2000 |
| WO | WO 2005042866 | 5/2005 |

*Primary Examiner* — Brian Glessner
*Assistant Examiner* — Omar Hijaz
(74) *Attorney, Agent, or Firm* — Knobbe, Martens, Olson & Bear, LLP

(57) ABSTRACT

A shearwall adapted for use in a building or other structure includes a main concrete portion and structural reinforcement positioned within the main concrete portion. The shearwall is configured to resist lateral forces to which the building or other structure may be subjected. Further, the shearwall is configured to accommodate a vertical load such that the need for at least one separate structural column is eliminated.

20 Claims, 12 Drawing Sheets

(51) Int. Cl.
*E04B 1/26* (2006.01)
*E04H 1/04* (2006.01)

(56) References Cited

U.S. PATENT DOCUMENTS 4,098,039 A * 7/1978 Sutelan ..... 52/73
4,282,690 A * 8/1981 Meheen ..... 52/79.11
4,575,978 A * 3/1986 Huhn et al. ..... 52/234
4,712,344 A * 12/1987 Erdei ..... 52/223.6
5,103,604 A * 4/1992 Teron ..... 52/79.14
5,671,569 A * 9/1997 Kobori et al. ..... 52/167.6
5,706,626 A 1/1998 Mueller
6,955,016 B1 * 10/2005 Churches et al. ..... 52/236.3
7,900,411 B2 * 3/2011 Antonic ..... 52/275
8,429,876 B2 * 4/2013 Aburto ..... 52/742.14
2005/0055922 A1 3/2005 Shamsai et al.
2006/0144008 A1 7/2006 Fouch et al.
2008/0022623 A1 * 1/2008 Brienen ..... 52/583.1
2010/0018151 A1 1/2010 Hiriyuk

* cited by examiner

STRUCTURAL SHEARWALL

CROSS-REFERENCE TO RELATED APPLICATIONS

This application is a continuation of U.S. patent application Ser. No. 12/568,614 filed Sep. 28, 2009 which claims the priority benefit under 35 U.S.C. §119(e) of U.S. Provisional Application No. 61/100,600, filed Sep. 26, 2008 and U.S. Provisional Application No. 61/151,126, filed Feb. 9, 2009, the entireties of which are hereby incorporated by reference herein.

BACKGROUND

1. Field of the Inventions

The present inventions relate to structural members for buildings and, more particularly, to shearwalls and column members for multi-story residential or commercial buildings.

2. Description of the Related Art

The use of shearwalls to resist lateral loads (e.g., seismic loads, wind loads, etc.) that may be imparted on a building or other structure are well known. In addition, the use of structural columns or similar members to accommodate vertical loads and stresses are also well known. In order to simplify the design and construction of structures (e.g., multi-story residential or commercial buildings) and to reduce costs, it is desirable to provide a shearwall that is configured to adequately resist both vertical and lateral loads. As a result, the quantity of stand-alone vertical columns can be advantageously reduced.

SUMMARY OF THE INVENTIONS

According to some embodiments of the present inventions, a shearwall adapted for use in a building or other structure includes a main concrete portion and structural reinforcement members (e.g., rebar) positioned within the main concrete portion. The shearwall is configured to resist lateral forces to which the building or other structure may be subjected. Further, the shearwall is configured to accommodate vertical load such that the need for at least one separate structural column is eliminated.

In some embodiments, a multi-story building or other structure can be constructed using reinforced concrete shearwalls and columns. In one embodiment, such a building or other structure includes between 3 and 24 stories. However, in other arrangements, the building has fewer than 3 stories or more than 24 stories. In some embodiments, the shearwalls are generally rectangular and shape. In other embodiments, the shearwalls and columns are positioned away from the periphery of a floor by a minimum setback (e.g., 7 feet, more than 7 feet, less than 7 feet, etc.). In other arrangements, the shearwalls are located generally perpendicular to the closest exterior wall or edge. In other embodiments, the shearwalls are configured to accommodate at least some of the vertical loading imparted on the building.

According to certain embodiments, a shearwall adapted for use in a multi-story building or other structure comprises a main concrete portion and structural reinforcement (e.g., rebar, other steel or metal members, etc.) positioned within the main concrete portion, without the use of a steel frame. In one arrangement, the shearwall is configured to resist the lateral forces to which the building or other structure may be subjected. In other embodiments, the shearwall is configured to accommodate a vertical load such that the need for at least one separate structural column is eliminated. In another arrangement, the main concrete portion includes ends, such that the shearwall is configured to accommodate the vertical load primarily at such ends. In certain embodiments, the shearwall is configured to be generally aligned with at least one vertically-adjacent shearwall positioned above or below the shearwall. In some configurations, the shearwall and at least one vertically-adjacent shearwall are structurally connected using at least one reinforcement member. In another embodiment, the shearwall comprises at least one reinforcement cage adapted to accommodate vertical load.

According to other arrangements, the shearwall is configured to be included in a building having between 3 and 24 stories. In other embodiments, however, the shearwall can be incorporated in buildings or other structures having more than 24 stories or fewer than 3 stories. In some embodiments, a floor-to-floor of the shearwall is approximately 10 feet. In other configurations, the floor-to-floor of the shearwall is greater than or less than approximately 10 feet. In some arrangements, a total floor area of each floor of the building or other structure utilizing the shearwall is approximately 30,000 square feet. However, in certain embodiments, the total floor area of such a building or other structure is greater than or less than approximately 30,000 square feet.

In accordance with certain arrangements, a method of reducing the construction cost of a multi-story building or other structure includes providing a plurality of steel-reinforced concrete shearwalls configured to accommodate both lateral and vertical loads and providing a plurality of steel-reinforced concrete columns configured to generally accommodate only vertical loads. The method further includes providing an upper floor slab above the shearwalls and columns, and a lower floor slab below the shearwalls and columns. In certain arrangements, the shearwalls are configured to accommodate substantially all of the shear load and at least a portion of the vertical load subjected on said building. In one embodiment, the building comprises at least 3 stories.

In certain arrangements, the shearwalls and columns are setback from an edge of building's floor plan (e.g., setback from the closest exterior wall). In other embodiments, the building comprises between 3 and 24 stories. However, in alternative embodiments, the building or other structure include more than 24 stories. In other embodiments, a total floor area of each floor of the building is approximately 30,000 square feet. However, in one configuration, the total floor area of each floor of the building is less than or greater than 30,000 square feet. In one embodiment, the upper and lower floor slabs comprise a tension tendon (e.g., a pre-tensioning, a post-tensioning tendon, etc.).

According to certain arrangements, a method of constructing a multi-story building or structure includes providing a plurality of reinforced concrete shearwalls configured to accommodate both lateral and vertical loads and providing a plurality of steel-reinforced concrete columns configured to generally accommodate only vertical loads. In some embodiments, each story of the building or other structure comprises a floor plan defined by outer periphery. In one embodiment, the shearwalls are configured to accommodate substantially all of the shear load and at least a portion of the vertical load subjected on said building. In other embodiments, the building comprises 3 or more stories. According to certain configurations, the shearwalls and columns are located away from the outer periphery of each story's floor plan by a minimum setback so as to permit the building to receive at least one design along its exterior without interfering with the shearwalls or columns. In one embodiment, the one design configured for placement along an exterior of the building includes an exterior skin, a cutback, a deck, another architectural element and/or the like. In certain arrangements, the building comprises between 3 and 24 stories. However, in other embodiments, the building includes more than 24 stories. In some embodiments, a total floor area of each floor of the building is approximately 30,000 square feet. However, in other embodiments, the total floor area of each floor of the building is more or less than 30,000 square feet. In some arrangements, each of the shearwalls is positioned generally perpendicularly relative to a portion of the outer periphery to which each of said shearwalls is closest. In certain embodiments, the minimum setback for the shearwalls and/or the columns is approximately 7 feet. However, in other configurations, the minimum setback is greater or less than 7 feet.

In some embodiments, the main concrete portion includes ends such that the shearwall is adapted to accommodate the vertical load primarily at said ends. In some arrangements, the shearwall is configured to be generally aligned with at least one vertically-adjacent shearwall positioned above and/or below the shearwall. In other embodiments, the shearwall and one or more vertically-adjacent shearwalls are structurally connected to each other using rebar and/or some other reinforcement member. In some embodiments, the main concrete portion comprises a generally rectangular shape. In some arrangements, the shearwall comprises at least one reinforcement cage configured to accommodate the vertical load.

According to some embodiments, a method of reducing the construction cost of a structure includes providing at least one shearwall configured to accommodate both lateral and vertical loads and providing at least one column configured to generally accommodate only vertical loads. The method additionally includes providing an upper floor slab above the shearwall and column and a lower floor slab below the shearwall and column. In some arrangements, the shearwall is configured to eliminate the need for one or more additional columns. In some embodiments, the upper and lower floor slabs comprise a pre-tensioning or post-tensioning tendon. In some embodiments, the structure comprises a multi-story residential or commercial building or the like.

According to some embodiments, the shearwalls and/or columns disclosed herein are configured to not exceed a total floor-to-floor height of 10 feet. In other arrangements, the shearwalls and/or columns disclosed herein comprise a floor-to-floor height that is greater than 10 feet. In one embodiment, a building or other structure comprising such shearwalls includes between 3 and 24 stories. However, in alternative arrangements, such buildings or structures include more than 24 stories. In certain embodiments, the total area of each floor of a building or other structure comprising such shearwalls is approximately 30,000 square feet. According to certain configurations, the total area of the floors of such buildings or other structures is approximately 20,000 to 40,000 square feet. In other configurations, the total area of the floors of such buildings or other structures is less or greater than 30,000 square feet, as desired or required. For instance, in one embodiment, the total area of the floors of such buildings or other structures is approximately, 5,000, 10,000, 15,000, 20,000, 25,000, 35,000, 40,000, 45,000, 50,000, 60,000, 70,000, 80,000, 90,000, 100,000 square feet, more than 100, 000 square feet, etc.

BRIEF DESCRIPTION OF THE DRAWINGS

These and other features, aspects and advantages of the inventions disclosed herein are described below with reference to the drawings of certain preferred embodiments, which are intended to illustrate and not to limit the inventions. The drawings comprise the following figures.

DETAILED DESCRIPTION OF THE PREFERRED EMBODIMENTS

The shearwalls, the columns, the structural layouts with which the shearwalls and columns are used, as well as the various systems and features associated with them, are described in the context of a concrete multi-story building because they have particular utility in this context. However, the shearwalls, columns, related structural layouts and methods described herein, as well as their various systems and features, can be used in other contexts as well, such as, for example, but without limitation, other types of structures that are required to resist both vertical and lateral forces.

Figure 1:
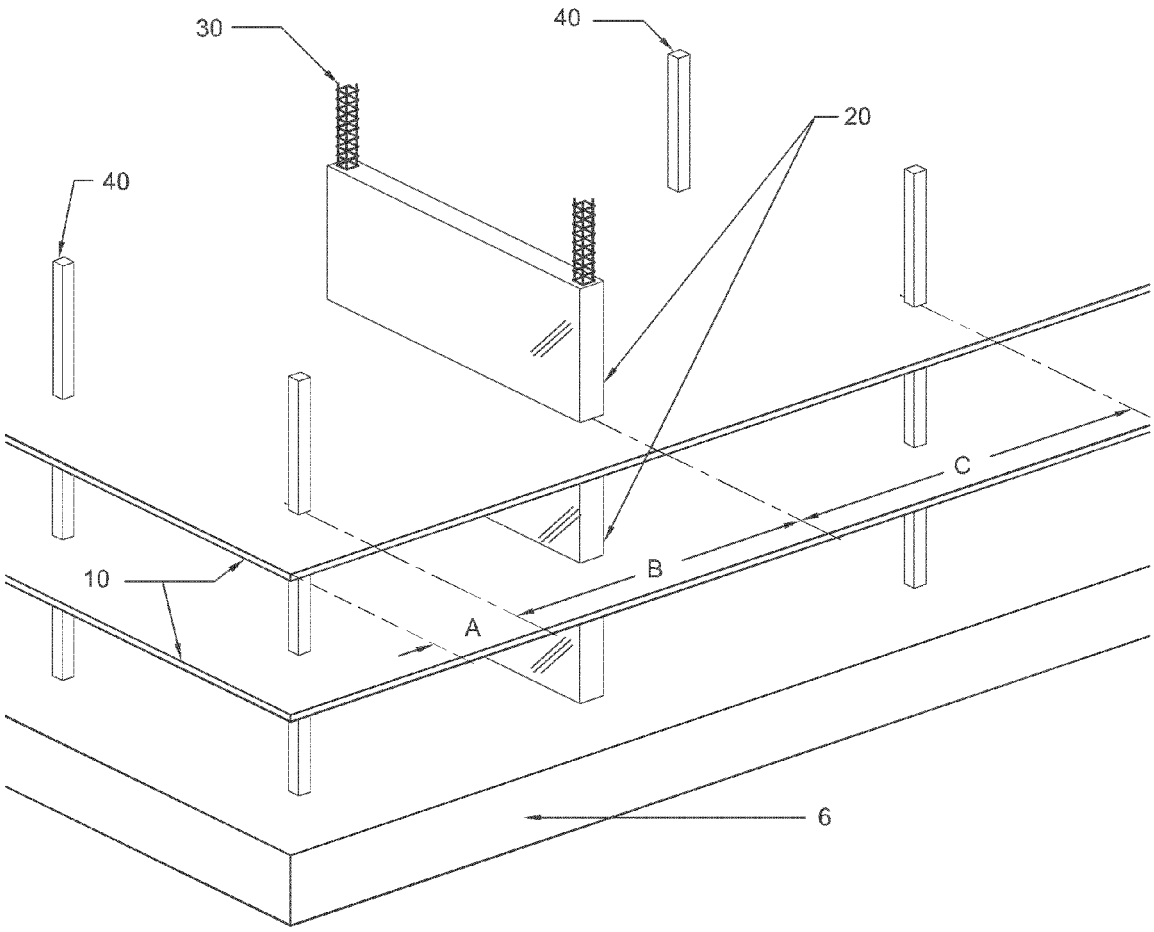
FIG. 1 is a schematic and partial perspective view of a portion of a multi-story building having a plurality of structural columns and a shearwall according to an embodiment.

With reference to FIG. 1, each floor 10 of a multi-story building can comprise one or more columns 40 and/or shearwalls 20 in order to adequately resist the forces (e.g., vertical and lateral), moments and other stresses to which the building may be exposed. In the illustrated arrangement, the shearwalls 20 include a reinforced steel cage 30 along each end. In some embodiments, some or most of the vertical loads imparted on the shearwall 20 are transferred at or near such steel cages 30 and/or other structural reinforcement members. However, in other embodiments, the shearwalls are generally uniform and do not include any cages or other reinforcing members at all. As discussed in greater detail herein, regardless of their exact configuration, such shearwalls can advantageously accommodate both vertical and lateral forces and stresses.

In some embodiments, the use of such combination shearwall/column members, together with stand-alone vertical columns, can help reduce construction costs, simplify the design of the structure, facilitate in the construction of the structure, reduce construction time and/or offer one or more other advantages. For example, the shearwalls can eliminate the need for one or more separate structural columns that would otherwise be required near the shearwall to accommodate vertical loads. For example, the use of such combination shearwall/column members in a multi-story building or other structure can lead to significant construction and/or design cost savings over conventional concrete and steel designs.

The shearwall members 20 can be positioned between one or more rows of separate or "independent" vertical columns 40, as desired or required by a particular design. For example, in the embodiment illustrated in FIG. 1, the edge of each floor includes columns 40 that are configured to generally accommodate only vertical loads and stresses. As shown, such columns 40 can be positioned at a particular distance A from the edge of the floor slab 10. One or more other columns 40 can also be positioned between the shearwalls 20 and the edge of the floor slab 10. Such additional columns 40 can be in-line with or offset from each other, as desired or required by a particular design.

With continued reference to FIG. 1, one or more combination shearwall/column members 20 can be positioned on each floor of the building or other structure at a particular offset distance B from the end columns 40. As discussed and illustrated in greater detail herein, such shearwalls 20 can be oriented so that their longer dimension generally parallels one of the two edges of the floor slab 10. However, in other embodiments, the shearwalls 20 are placed so that they are not parallel with either edge of a floor slab 10.

In FIG. 1, an additional row of structural columns 40 can be positioned on each floor at a distance C away from the shearwall 20. As discussed herein, such columns 40 can be parallel to each other, to the shearwall 20 and/or any other component, feature or portion of the structure. As illustrated herein with reference to FIG. 2, a particular floor of a building or other structure can include shearwall members 20 that are oriented along two or more different directions (e.g., skewed at a 90-degree angle from each other, skewed at some other angle, etc.).

With continued reference to FIG. 1, according to some embodiments, the distances A, B and C, denoting the spacing between adjacent columns and/or shearwalls, are approximately 7 feet (ft), 21 ft and 28 ft, respectively. However, in other arrangements, one or more of such offset distances may be greater or less than disclosed above, as desired or required by particular design or application.

In some embodiments, the foundation 6 and/or one or more floor slabs 10 of the building or other structure comprise steel-reinforced concrete. Depending on the size of the foundation or slabs, the magnitude of forces, moments and other stresses to which the structure may be subjected and/or one or more other considerations, the foundation 6 and/or the floor slabs 10 can be pre-stressed, post-stressed and/or otherwise configured to have improved structural characteristics.

Figure 2:
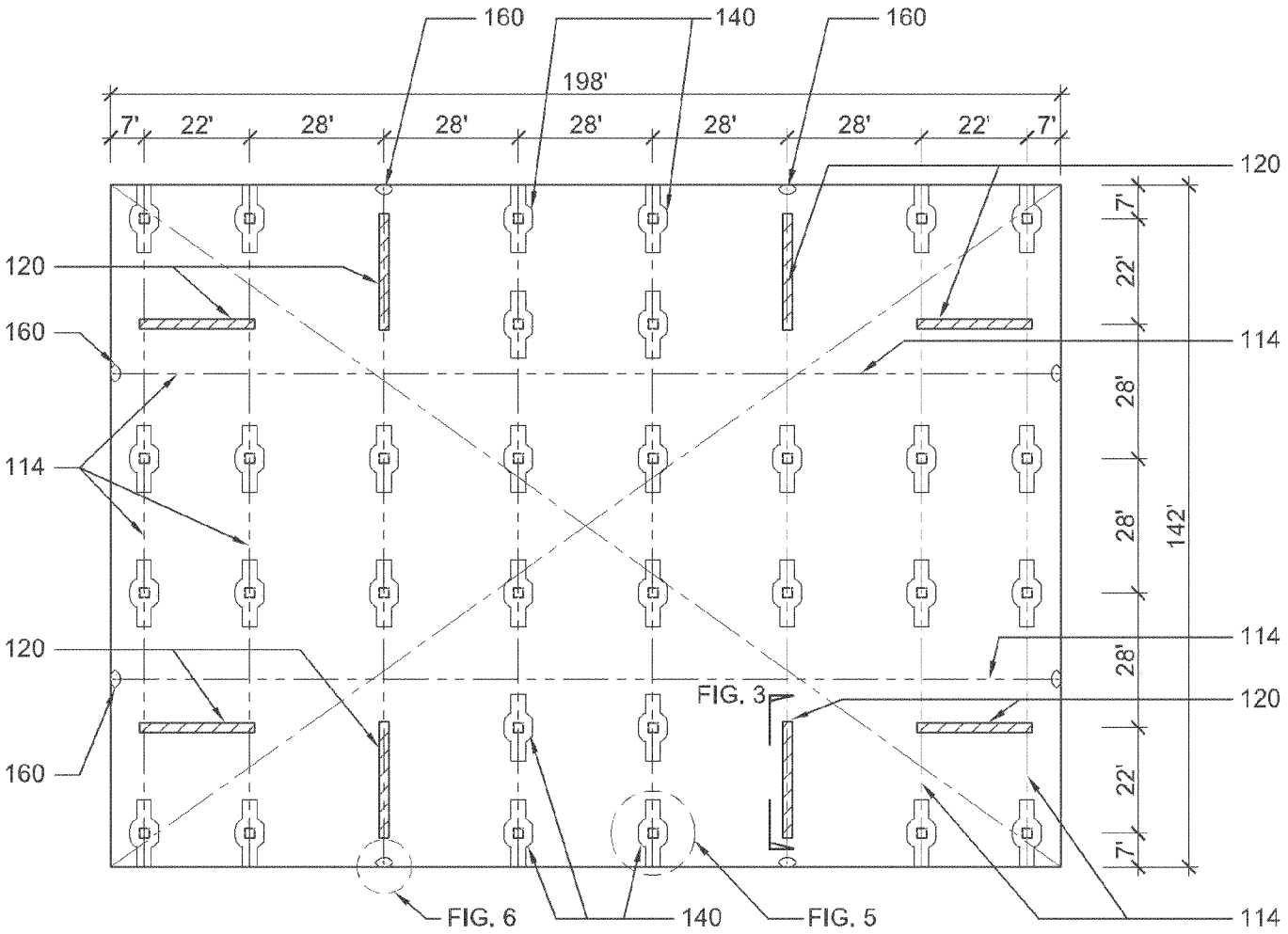
FIG. 2 illustrates a top view of a building's floor plan having a plurality of column members, shearwalls and other features according to another embodiment.

Another embodiment of an engineering plan showing the general layout of the various structural and non-structural components of a building is illustrated in FIG. 2. The depicted floor, which has an area of approximately 28,116 square feet (198 ft by 142 ft), includes a total of eight shearwalls 120 and thirty-two structural columns 140. As discussed with reference to the embodiment of FIG. 1, the shearwalls 120 can be advantageously configured to accommodate both vertical and lateral loads, moments and stresses, while the columns 140 can be configured to generally accommodate only vertical forces. The structural layout illustrated in FIG. 2 can be for one or more floors of a multi-story building (e.g., residential, commercial, industrial, etc.) or other structure. Each floor of such a building or other structure can include a similar or a different layout of columns 140 and/or shearwalls 120, as well as other structural or non-structural components or features (e.g., openings, non-structural members, etc.), as desired or required by a particular design.

According to certain embodiments, the shearwalls, columns and/or other structural components disclosed herein, or variations thereof, can be used in buildings or other structures having a floor plan size of approximately 30,000 square feet (sq ft) or more per floor. For example, floors of this size can be configured to advantageously accommodate all employees of a company (or one or more of its departments or divisions, or portions thereof). In other arrangements, the floor plan size of a building or other structure comprising the structural components described herein can be smaller or larger than 30,000 sq ft (e.g., less than 5,000 sq ft, 5,000 sq ft, 10,000 sq ft, 15,000, sq ft, 20,000 sq ft, 25,000 sq ft, 35,000 sq ft, 40,000 sq ft, 45,000 sq ft, 50,000 sq ft, 60,000 sq ft, 70,000 sq ft, 80,000 sq ft, 90,000 sq ft, 100,000 sq ft, more than 100,000 sq ft, areas between such ranges, etc.). According to certain configurations, the total area of the floors of such buildings or other structures is approximately 20,000 to 40,000 square feet.

In some arrangements, the size, shape, structural characteristics and/or other properties of the shearwalls and/or columns disclosed herein generally remain the same from one design to the next, regardless of the shape, size, general layout and orientation and other design details of the floors into which such shearwalls and/or columns are installed. Thus, only the quantity, spacing (e.g., relative to each other, the edge of the floor, elevator or stairwell shaft and/or other reference point, etc.), orientation and other layout details of the shearwalls and/or columns may need to be altered based on the specifications of a particular building or other structure. Such a modular approach can help simplify the structural design of a building or other structure, decrease design and construction costs, reduce time of construction and/or provide one or more additional benefits. However, in other embodiments, the shearwalls and/or columns are customized for the particular building or other structure into which they will be installed.

With continued reference to FIG. 2, the columns 140 can be oriented along a regular grid pattern. For example, in the illustrated layout, the columns 140 are spaced either 22 ft or 28 ft from each other. In addition, the depicted columns 140 are approximately 7 ft from the respective edge of the floor slab 110. In FIG. 2, the layout of the columns 140 and shearwalls 120 is generally symmetrical in both horizontal dimensions. However, the spacing between adjacent columns 140 and/or between columns 140 and the edge of the floor slab 110 can vary based on the specific design considerations or inputs and other characteristics (e.g., size, construction materials, loads, moments and stresses to which the building will be subjected, etc.). Further, the size, shape and other structural properties of the columns 140 and/or the shearwalls 120 can vary according to certain target design parameters.

By way of example, in certain arrangements, the size (e.g., length, thickness, other dimensions, etc.) of the shearwalls depends on the site location, the soil type on which the structure will be constructed, the size of the structure (e.g., number of stories, overall height, etc.), the location of the shear walls, the location of the columns, the size (e.g., area) of the floor plate and/or one or more other factors or considerations. Likewise, the size and location of the columns can depend on one or more factors, such as, for example, the size (e.g., dimensions) of the floor plan, the size of the structure (e.g., number of stories, overall height, etc.), the location of the shear walls, the location of the columns, the architectural layout of the floor and overall structure and/or the like. The specific shearwall and column characteristics generally vary from project to project according to the specific design parameters involved.

In FIG. 2, each shearwall 120 is shaped, sized and otherwise configured to generally replace two of the stand-alone vertical columns 140. However, in other arrangements, a shearwall designed in accordance with the present application may be configured to replace fewer (e.g., one) or more (e.g., 3 or more) vertical columns 140. For example, in the depicted embodiment, each shearwall 120 is approximately 22 ft long, which generally matches the distance between some of the adjacent columns 140. Further, as shown, some of the shearwalls 120 can be rotated (e.g., 90 degrees) relative to each other. This can help ensure that lateral forces, such as those generated by wind, seismic events or the like, can be adequately accommodated by the building or other structure, regardless of their direction. The shearwalls 120 can be positioned at or near the outer edges or portions of a particular floor. Alternatively, the shearwalls 120 can be positioned closer to the center of the floor (e.g., away from the edges), as desired or required.

According to certain embodiments, as illustrated in FIG. 2 (as well as in at least some of the arrangements illustrated in FIGS. 7-12), the shearwalls and the columns are generally positioned away (or setback) from all or some of the edges, periphery or perimeter of the floor. Therefore, in some embodiments, a building's floor plan does not include shearwalls and/or columns at or near one or more of the floor plan's edges or outer periphery. For example, in FIG. 2, the shearwalls 120 and columns 140 are positioned at least 7 feet away from all edges of the floor plan. In other embodiments, however, the setback can be smaller or greater than 7 feet, as desired or required by a particular design. In addition, the shearwalls and columns can be setback from the respective edge of the floor on fewer than all sides of the building or other structure.

Providing such a setback for the shearwalls and/or columns can provide certain benefits. For instance, the setback can advantageously permit the building or other structure to receive a wide variety of exterior skins, designs, architectural elements, decks (e.g., penthouse decks), cutbacks in the buildings, other features and/or the like. Accordingly, such configurations provide greater flexibility to customize a building or other structure, particularly when compared to designs that have shearwalls, columns or other structural members along the edge of a floor.

As discussed herein, in some embodiments, the shearwalls 120 are configured to accommodate vertical loads imparted upon them. Thus, the shearwalls 120 can be substituted for one or more stand-alone vertical columns 140. For example, in the embodiment illustrated in FIG. 2, each shearwall 120 can effectively eliminate the need for two vertical columns 140 that would otherwise be positioned in that location. Accordingly, in some arrangements, each shearwall 120 illustrated in FIG. 2 can accommodate the vertical load of two stand-alone columns 140. The shearwall 120 can be configured to spread such vertical loads along its entire length or only at certain selected points (e.g., at or near the edges of the shearwall 120).

According to certain embodiments, the maximum floor-to-floor height of the shearwalls disclosed herein is 10 feet or approximately 10 feet. However, the wall-to-wall vertical height of a shearwall can be greater or less than 10 feet, as desired or permitted. Such dimensional and other types of restrictions may be required by state, local or other building codes or other building regulations or guidelines. Further, in some arrangements, due to building codes or other design limitations, a building or other structure comprising such shearwalls may not be permitted to exceed a total height (e.g., 240 feet). Thus, if the total height of a building is limited to 240 feet and if the shearwalls are configured to extend 10 feet between adjacent floor slabs, the building or other structure comprising such shearwalls may not be permitted to exceed 24 stories. Consequently, in some embodiments, the various embodiments of the shearwalls discussed herein can be used in the design of buildings or other structures that comprise up to 24 stories. In one embodiment, the shearwalls can be utilized in building or other structures comprising 3-24 stories. However, in other configurations, based on applicable building codes, other restrictions and/or other design considerations, such shearwalls can be included in buildings or other structures that are taller than 240 feet (e.g., 250 feet, 300 feet, 400 feet, 500 feet, more than 500 feet, heights between these values, etc.) and/or comprise more than 24 stories (e.g., 25, 30, 40, 50, 60, 70, 80, 90, 100, more than 100 stories, quantities between these values, etc.), as desired or required.

As discussed herein, the floor plan size of a building or other structure comprising the shearwalls and columns disclosed herein such can be approximately 30,000 sq ft. Alternatively, the size of the floor plan of such buildings or structures can be smaller or larger than 30,000 sq ft (e.g., less than 5,000 sq ft, 5,000 sq ft, 10,000 sq ft, 20,000 sq ft, 40,000 sq ft, 50,000 sq ft, more than 50,000 sq ft, areas between such ranges, etc.), as desired or required.

Further advantages can be achieved by arranging shearwalls such that they extend, in their longitudinal direction, inwardly, for example, generally perpendicularly, from the closest edge of the floor on which they are arranged. For example, as shown in FIG. 2, all of the shearwalls 120 extend inwardly toward the interior of the building and generally perpendicular to the closest edge of the floor on which they are disposed. In some embodiments, the shearwall arrangement forms an annular pattern of generally radially oriented shearwalls, surrounding centrally-located elevator shafts of a building. This can provide an advantage in terms of increasing the space available for windows for the building. Further, as shown in FIG. 2, such an arrangement of shearwalls can eliminate the need for shearwalls encasing the elevator shafts which is common in prior art buildings.

According to certain embodiments, as illustrated in the floor plans of FIGS. 2 and 7-12, the shearwalls are arranged in a manner that may reduce the likelihood of interference with one or more wireless signals. For example, in some prior art designs, shearwalls are located along and parallel to the building's exterior walls. Thus, by orienting the shearwalls perpendicularly to the closest exterior wall, as depicted in the arrangements of FIGS. 2 and 7-12, interference to cell phone, Wi-Fi (e.g., IEEE 802.11) and/or other analog or digital signals can be advantageously reduced. In other prior art designs, shearwalls are located at or near the core (e.g., center) of a building (e.g., adjacent an elevator shaft). Thus, the various shearwall layouts disclosed herein, or equivalents thereof, can help reduce the interference of wireless signals attempting to pass through the building's core or other interior region where shearwalls may otherwise be concentrated.

For example, in some known prior art shearwall arrangements, the shearwalls are arranged parallel to and generally along the closest edge of the floor on which they are disposed. Such facade-parallel shearwalls typically reduce the total amount of outer wall available for windows and/or other architectural or structural features (e.g., exterior skins or other designs, decks, cutbacks, etc.

The various embodiments of reinforced shearwalls and columns disclosed herein can help simplify the design and construction of various buildings and other structures. In some arrangements, the buildings and other structures that incorporate the shearwalls, columns and general design elements discussed herein can replace more intricate and more expensive steel-based designs. Relatedly, the overall time of construction can be advantageously reduced, while still meeting and exceeding any applicable building codes and regulations.

Figure 12:
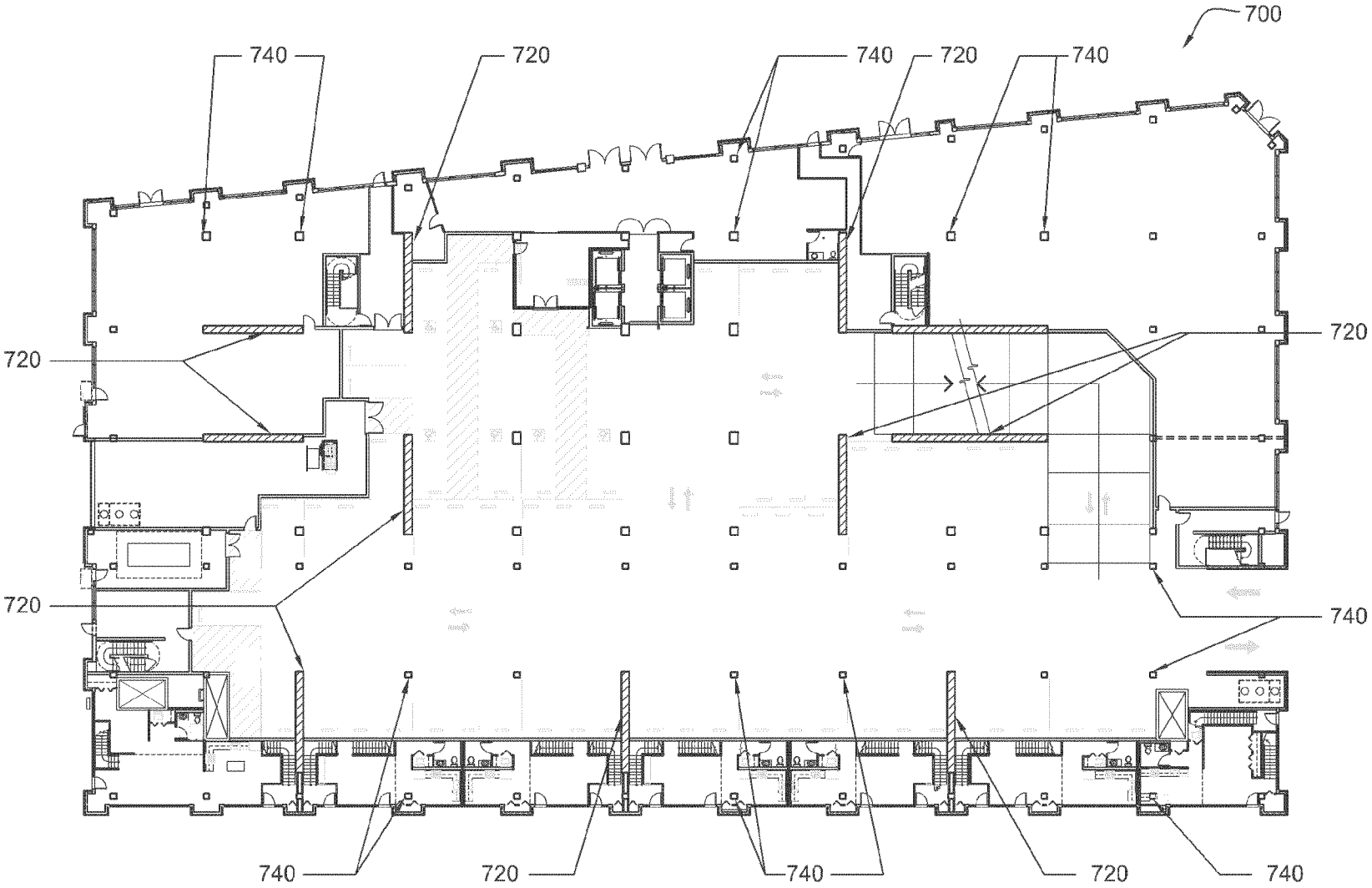

As illustrated in FIGS. 2 and 7-11, the general configurations of the shearwalls and columns disclosed herein can be incorporated into buildings having generally rectangular floor plans. In certain embodiments, such rectangular designs can further decrease the overall cost (e.g., design, construction, etc.) of a building or other structure. In addition, such designs can provide more enhanced seismic and/or other structural stability. However, in other arrangements, as illustrated in FIG. 12, the shearwall and column designs disclosed herein can be incorporated into floor plans that are not rectangular (e.g., circular, oval, trapezoidal, other polygonal, random, etc.). For example, additional shearwalls and columns can be strategically positioned in floor plans that include extended areas beyond the limits of a typical rectangular plan, in order to safely accommodate the expected forces (e.g., vertical, shear, etc.) and moments to which the building may be exposed.

According to some embodiments, the layout of columns 140 and/or the shearwall members 120 of two or more floors of a building or other structure can be generally horizontally aligned with one another. For example, the columns 140 and/or shearwalls 120 can be situated exactly or nearly exactly above and below each other throughout the entire building or structure. Alternatively, the position of such structural members can vary from floor to floor so that at least some of the columns 140 and/or the shearwalls 120 of different floors are not horizontally or laterally aligned.

Figure 3:
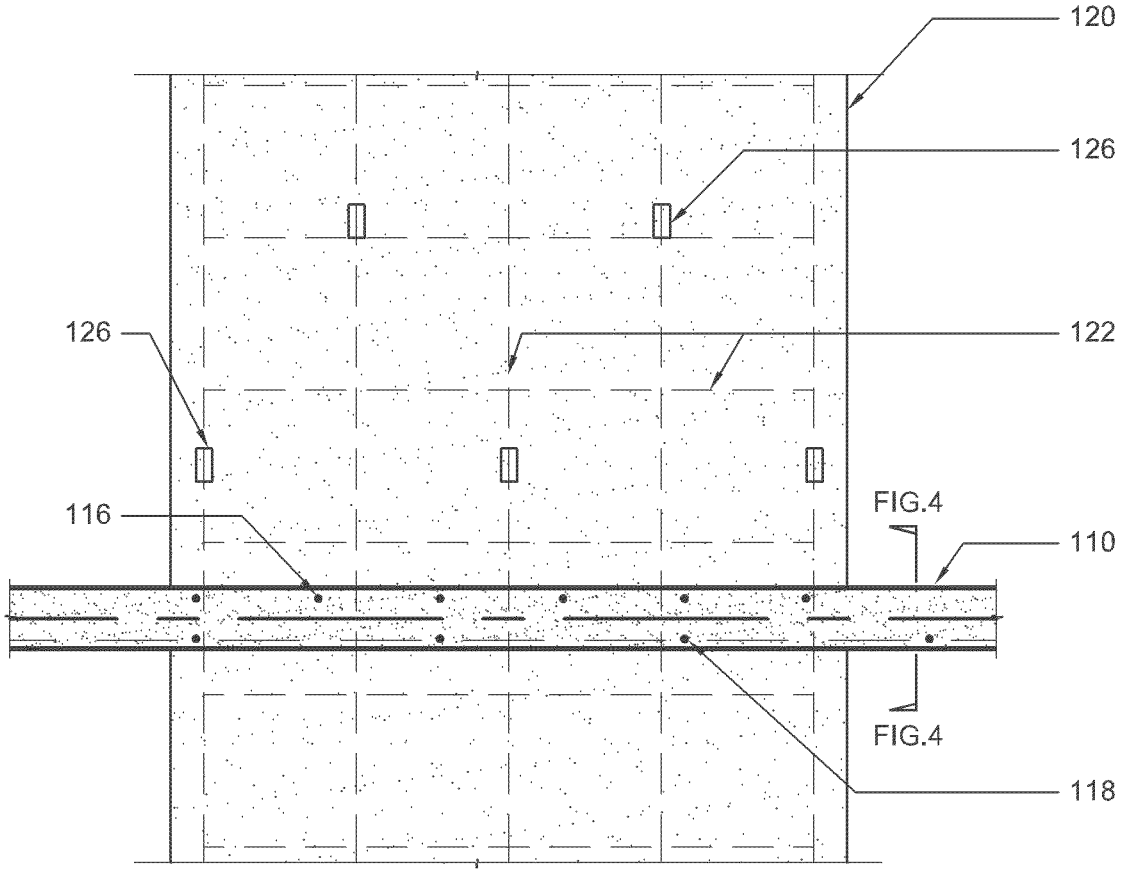
FIG. 3 illustrates a side view of a shearwall shown in FIG. 2 extending through a concrete slab separating two floors of the building according to one embodiment.

FIG. 3 illustrates one embodiment of a shearwall 120 that generally extends across at least two adjacent floors of a building or other structure. In addition, vertically-adjacent shearwalls 120 can be structurally attached to each other by extending the reinforcement members (e.g., rebar) through the intermediate floor slab 110. In the depicted arrangement, the slab 110 separating the adjacent floors is pre-stressed with a plurality of tendons 114, other tensioning members and/or the like. As discussed herein, such pre-stressing can help enhance the structural characteristics of the floor slab 110. For example, larger floor slab sections can be provided if pre-stressing, post-stressing or some other structural improvement treatment or method is utilized. In other embodiments, the floor slabs 110 and/or other concrete portions of the building or structure are not pre-stressed, post-stressed or otherwise configured to structurally enhance them.

With continued reference to the elevation illustrated in FIG. 3, the floor slab 110 can further include upper and lower reinforcement members 116, 118 (e.g., rebar, mesh, etc.) to provide the desired or required structural characteristics to the structure. In addition, the combination shearwall/column members 120 can include their own structural reinforcement 122 (e.g., rebar, mesh, etc.), as desired or required. Rebar or other reinforcement members within the shearwall 120 and/or other reinforced components of a structure can be lapped to create generally continuous reinforcement, both within a single shearwall member and in two or more separate shearwalls (e.g., across a floor slab). Such overlapping 126 of adjacent rebar or other reinforcing members can be accomplished using mechanical splicing, lap splicing, weld splicing and/or any other method. Further, the quantity, size, shape, positioning, overlapping or other joining method and/or other characteristics of the rebar or other reinforcing members can vary as desired or required by a particular design.

Figure 4:
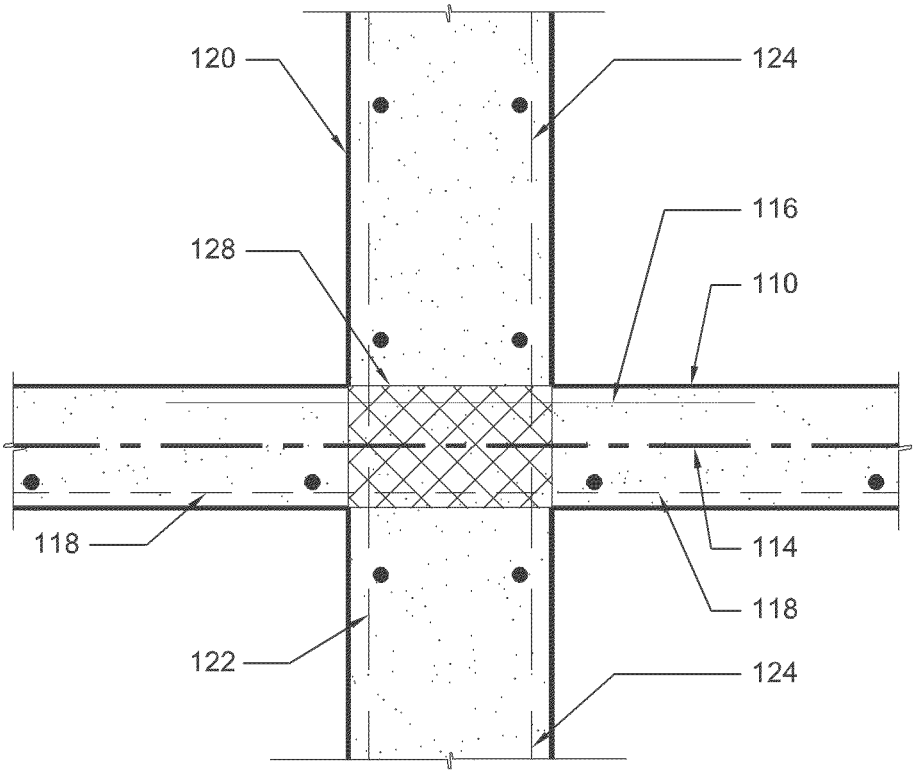
FIG. 4 illustrates a cross sectional view through the concrete slab, identified by the line 4-4 of FIG. 3.

FIG. 4 illustrates a cross-sectional view of the interface between the floor slab 110 and adjacent shearwalls 120 positioned above and below the floor slab 110. As discussed herein with reference to FIG. 3, the floor slab 110 can be pre-tensioned or post-tensioned with one or more tendons 114 to help enhance its structural characteristics. In addition, the floor slab 110 can comprise rebar 116, 118 and/or other reinforcing members, as desired or required by a particular application or design. Further, in some embodiments, as depicted in FIG. 4, adjacent upper and lower combination shearwall/column members 120 are generally aligned with one another across the floor slab 110. In addition, the shearwalls 120 can include rebar and/or other reinforcement 122, 124 to provide the desired tensile strength and other structural properties. In some embodiments, as illustrated in FIG. 4, the rebar 122, 124 can extend, at least partially, through the floor slab 110, and thus, can effectively structurally connect adjacent shearwalls 120 to one another.

With continued reference to FIG. 4, a portion 128 of the concrete slab 110 that generally extends between adjacent shearwall members 120 can be configured to have structural strength characteristics that match or generally match those of the shearwalls 120. However, in other embodiments, the structural characteristics of such a region 128 of the concrete slab 110 are different from the adjacent shearwalls 120.

Figure 5:
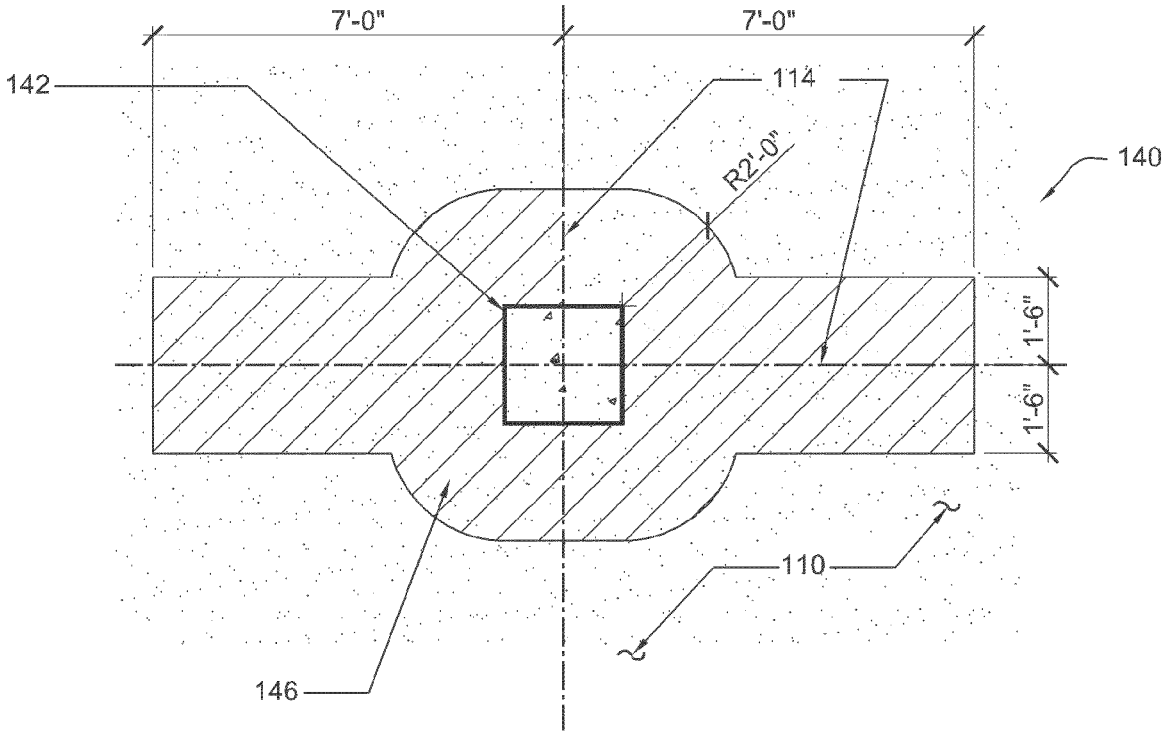
FIG. 5 is a schematic top plan and sectional view of one embodiment of a column included in the floor plan of FIG. 2.

One embodiment of a column 140 that can be used in conjunction with a combination shearwall/column member 120 disclosed herein is illustrated in FIG. 5. As shown, the main portion 142 of the column 140 comprises a square cross-sectional shape that is configured to extend between adjacent (e.g., upper and lower) floor slabs 110 of the building or other structure. Although not illustrated in FIG. 5, the column 140 can include rebar and/or other reinforcing members to provide it with the necessary tensile strength and/or other desired structural properties.

With continued reference to FIG. 5, in some embodiments, tendons 114 used to pre or post stress the floor slab 110 are configured to intersect or otherwise cross each other at the same centerline location as the columns 140. Further, in order to protect the columns 140, the tendons 114 and/or any other components or features of the structure, a shielded area 146 can be provided around the main portion 142 of each column 140. In some embodiments, in order to sustain the structural integrity of the columns 140, no penetrations can be situated with the protected area 146. For example, in the depicted arrangement of the column 140, which is approximately 14 feet long, such an area 146 extends approximately 2 feet around the exterior of the main column portion 142. In addition, as shown, such a protected area 146 can extend further in the direction of one of the tendons 114, as desired or required. In other embodiments, the column 140 can be designed with a different protected area 146 or without a protected area at all.

Figure 6:
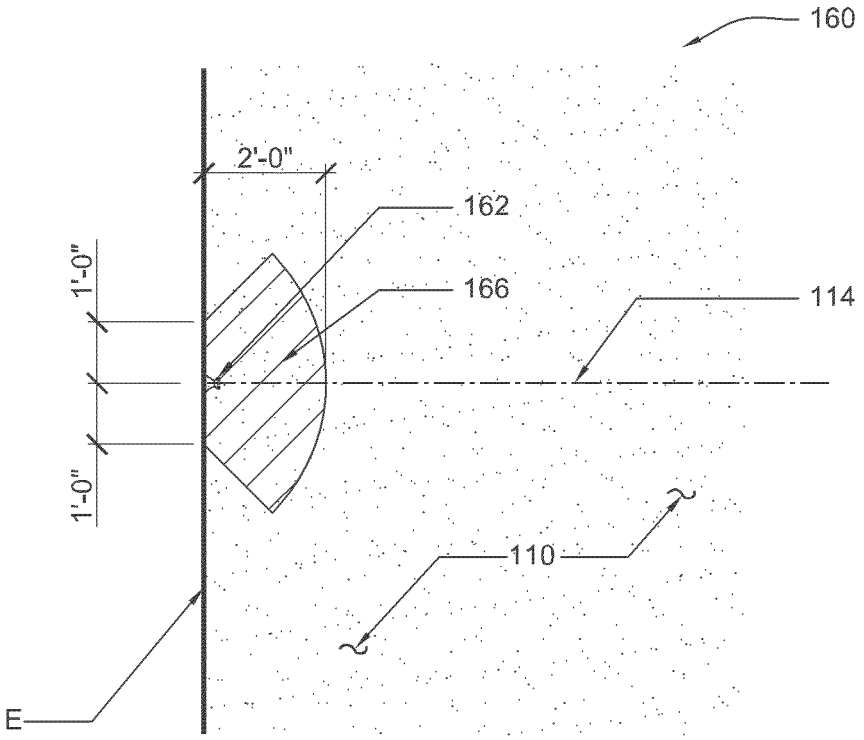
FIG. 6 illustrates a top view of one embodiment of a portion the building floor plan of FIG. 2 where a tensioning tendon or other structural member positioned within the slab can be secured.
Figure 7:
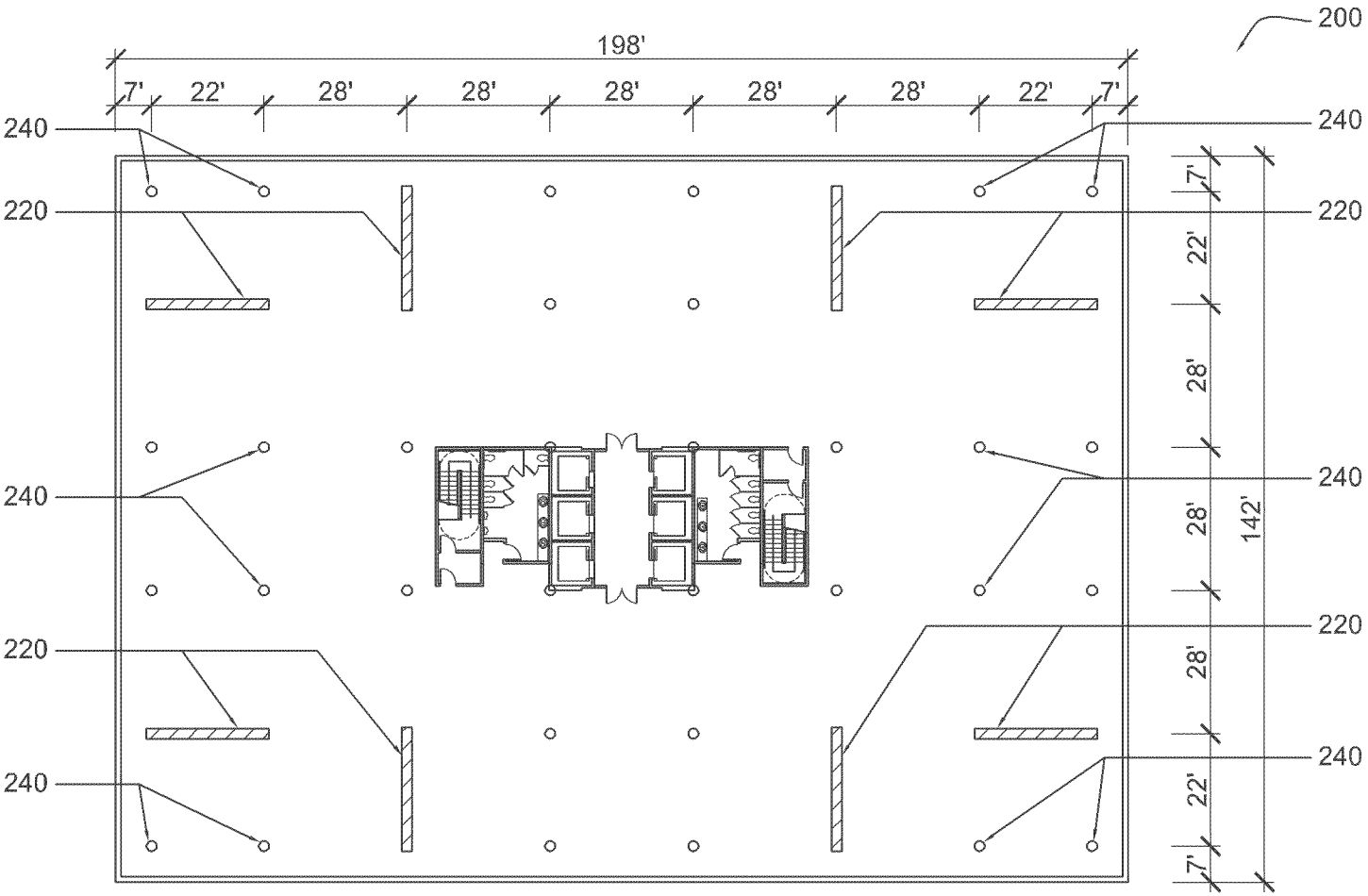
FIGS. 7-12 illustrate top views of various non-limiting embodiments of building floor plans having a plurality of column members, shearwalls and other features.
Figure 8:
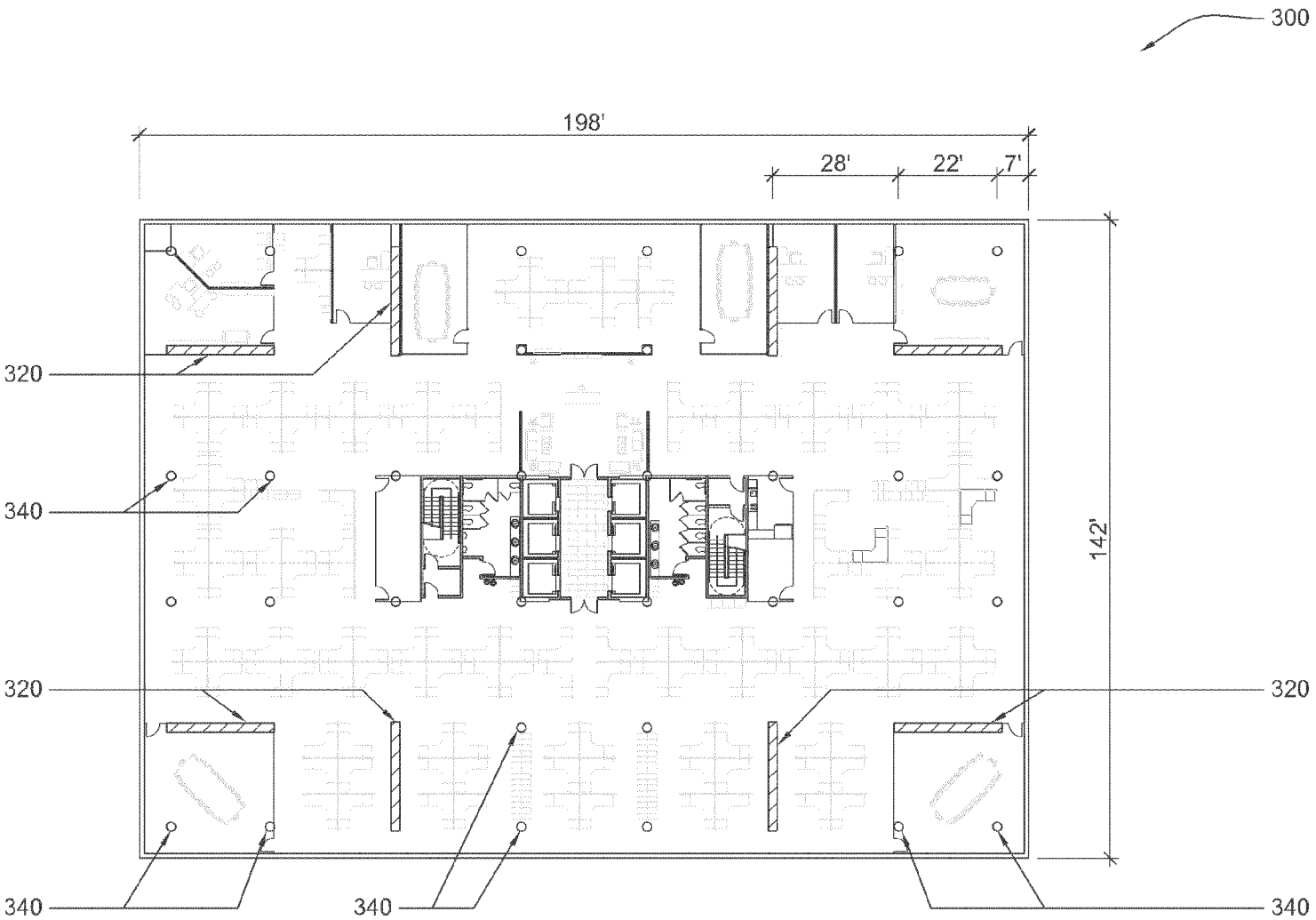
Figure 9:
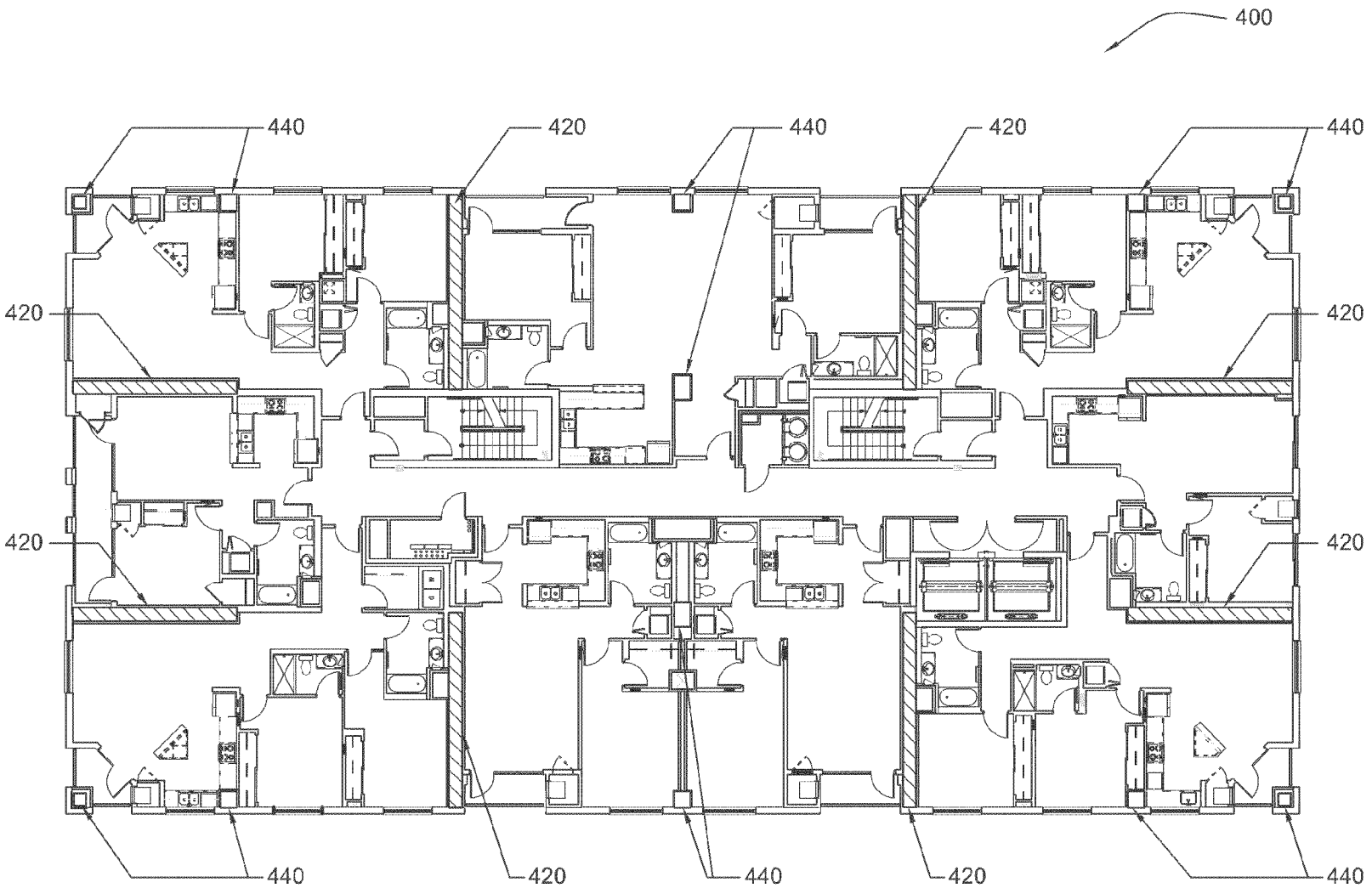
Figure 10:
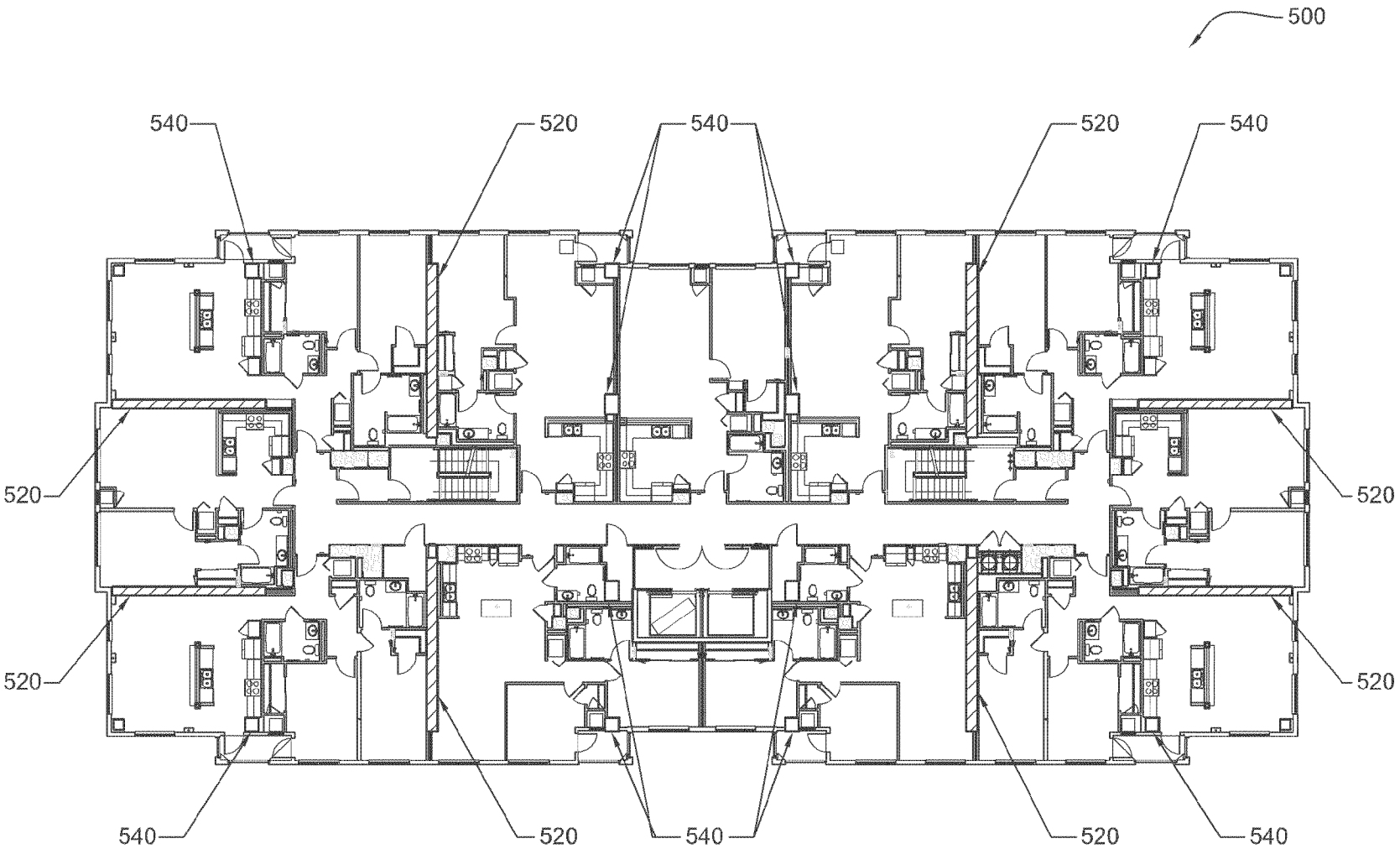
Figure 11:
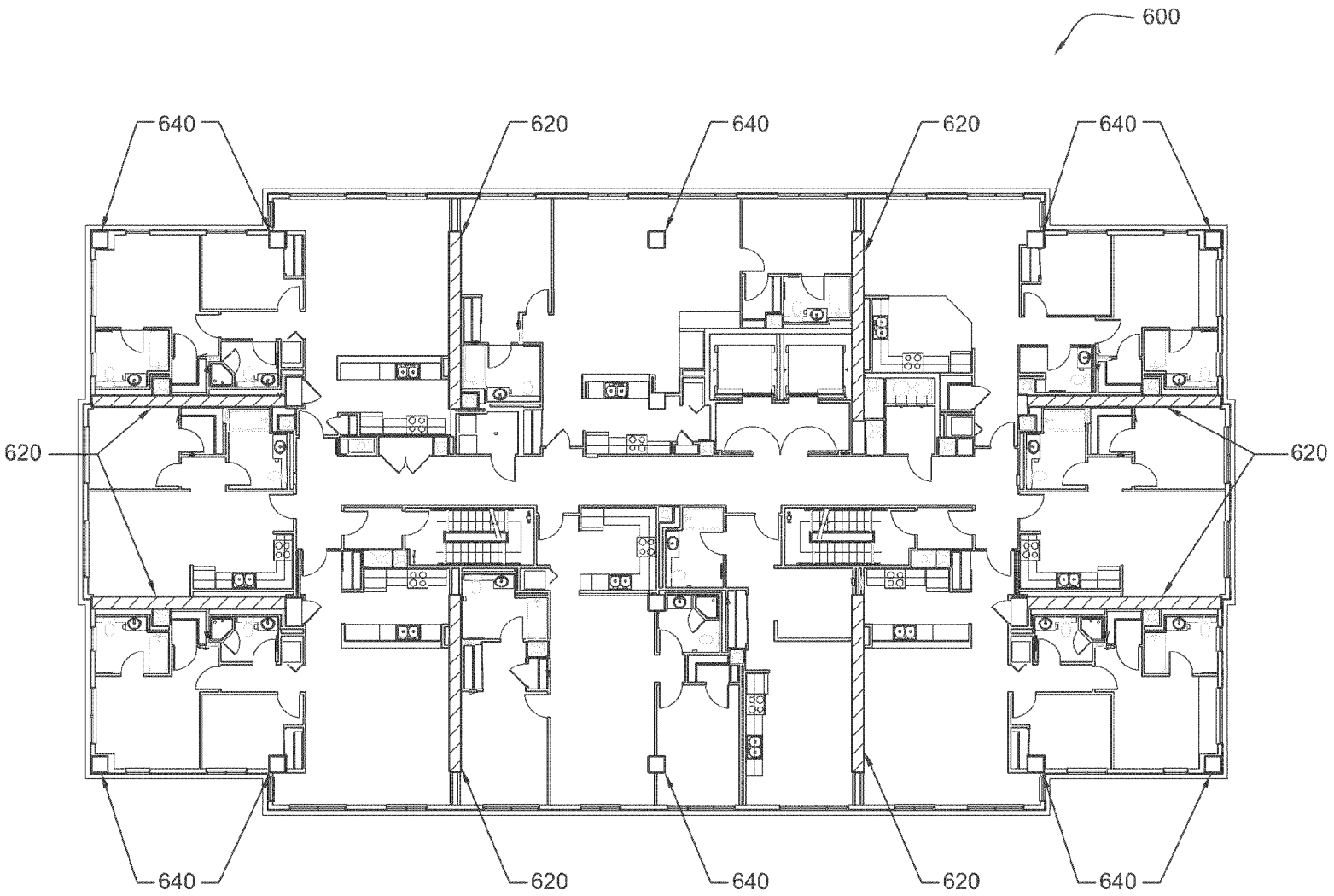

FIG. 6 illustrates one embodiment of an edge portion E of the floor slab 110 at or near which a structural tendon 114 of the slab 110 is secured. As shown, the ends of the tendon 114 can be held in place at specific tie-in locations 162. Alternatively, one or more tendons 114 can be placed within a concrete slab 110 when the slab 110 is being formed. In addition, one or more other methods or devices of securing the tendons 114 to the slab 110 and/or any other portion of the building or structure may be used, as desired or required.

As discussed herein with reference to the columns 140 (FIG. 5), the concrete slab 110 can include one or more protected portions 166 near the edge E of the slab and/or any other area to help protect the structural integrity of the tendons 114. In the embodiment illustrated in FIG. 6, such a protected area 166 includes a generally curved or rounded outer shape and extends to the edge E of the slab 110. However, in other arrangements, the shape, size, location and/or other details of the protected area 166 can vary.

As noted herein, FIGS. 7-12 illustrate top views of various non-limiting embodiments of building floor plans having a plurality of column members, shearwalls and other features. According to certain arrangements, the shearwalls and the columns can be positioned away from the outer periphery of a floor (e.g., at a minimum setback from the exterior walls). In addition, the shearwalls can be oriented generally perpendicularly relative to the closest peripheral edge or closest exterior wall. Such embodiments can provide one or more benefits, such as permitting the building to receive a wide variety of exterior skins, designs, architectural elements, decks (e.g., penthouse decks), cutbacks in the buildings, other features and/or the like. Further, the use of reinforced concrete shearwalls, columns and other structural components can simplify the overall design, facilitate construction and reduce costs. In addition, such layouts can help reduce the likelihood of signal interferences to certain interior portions of the building.

Although these inventions have been disclosed in the context of a certain preferred embodiment and examples, it will be understood by those skilled in the art that the present inventions extend beyond the specifically disclosed embodiment to other alternative embodiments and/or uses of the inventions and obvious modifications and equivalents thereof. In addition, while several variations of the inventions have been shown and described in detail, other modifications, which are within the scope of this invention, will be readily apparent to those of skill in the art based upon this disclosure. It is also contemplated that various combinations or subcombinations of the specific features and aspects of the embodiments or variations can be made and still fall within the scope of the invention. It should be understood that various features and aspects of the disclosed embodiment can be combined with or substituted for one another in order to form varying modes of the disclosed invention. Thus, it is intended that the scope of the present inventions herein-disclosed should not be limited by the particular disclosed embodiments described above, but should be determined only by a fair reading of the claims that follow.

What is claimed is:

1. A method of modularly constructing a multi-story building in a cost-efficient manner, the method comprising:

positioning a plurality of shearwalls and a plurality of structural columns along each floor of the building, wherein each floor comprises a first central axis along a length of each floor, and a second central axis along a width of each floor, wherein the second central axis is perpendicular to the first central axis, wherein the shearwalls and the columns from adjacent floors of the building are generally aligned with each other;

wherein the first and second central axes divide each floor into four floor quadrants, wherein each floor quadrant comprises at least two shearwalls, wherein the at least two shearwalls located within each floor quadrant are oriented perpendicular to one another, and wherein the at least two shearwalls in each quadrant are separate and distinct from shearwalls in adjacent quadrants;

wherein the shearwalls are configured to accommodate both vertical and lateral loads, and wherein the columns are configured to accommodate primarily vertical loads;

wherein all shearwalls and all columns included on a floor are located away from an outer periphery of each floor by a minimum setback so as to permit the building to receive at least one element or feature along an exterior of the building without interference from the shearwalls or the columns; and wherein a layout of the shearwalls and the structural columns is generally symmetrical both along the first central axis and the second central axis of each floor.

2. The method of claim 1, wherein the method facilitates overall construction of a building, as a size, a shape and structural characteristics of the shearwalls and the structural columns remain the same irrespective of a specific building design.

3. The method of claim 1, wherein the minimum setback is 7 feet.

4. The method of claim 1, wherein the element or feature along an exterior of the building comprises at least one of a window, an exterior skin, an architectural element, a deck and a cutback.

5. The method of claim 1, wherein the shearwalls are arranged such that they extend inwardly and perpendicularly from a nearest outer edge of the building.

6. The method of claim 1, wherein the shearwalls and the structural columns are oriented along a grid.

7. The method of claim 1, wherein each quadrant of the floor includes a first shearwall and a second shearwall, wherein the first shearwall is generally perpendicular to the second shearwall.

8. The method of claim 1, wherein the floor comprises at least one tension tendon.

9. The method of claim 8, wherein the tension tendon is a pre-tensioning or post-tensioning tendon.

10. The method of claim 1, wherein the building comprises between 3 and 24 stories.

11. The method of claim 1, wherein a total floor area of each floor of said building is approximately 30,000 square feet.

12. A method of modularly constructing a multi-story building in a cost-efficient manner, the method comprising:

positioning a plurality of shearwalls and a plurality of structural columns along each floor of the building;

wherein the shearwalls are configured to accommodate both vertical and lateral loads, and wherein the columns are configured to accommodate primarily vertical loads; and wherein all shearwalls and all columns included on each floor are located away from an outer periphery of each floor by a minimum setback so as to permit the building to receive at least one element or feature along an exterior of the building without interference from the shearwalls or the columns;

wherein a layout of the shearwalls and the structural columns is generally symmetrical in a first longitudinal direction and a second longitudinal direction of each floor, wherein the second longitudinal direction is perpendicular to the first longitudinal direction; and wherein the shearwalls are arranged such that they extend inwardly and perpendicularly from a nearest outer edge of the building, and wherein a first shearwall and at least one second shearwall are located along each quadrant of each floor, the first shearwall comprising an orientation that is generally perpendicular to an orientation of the at least one second shearwall in each quadrant.

13. The method of claim 12, wherein the method facilitates overall construction of a building, as a size, a shape and structural characteristics of the shearwalls and the structural columns remain substantially the same irrespective of a specific building design.

14. The method of claim 12, wherein the minimum setback is 7 feet.

15. The method of claim 12, wherein the element or feature along an exterior of the building comprises at least one of a window, an exterior skin, an architectural element, a deck and a cutback.

16. The method of claim 12, wherein the shearwalls and the structural columns are oriented along a grid.

17. The method of claim 12, wherein each quadrant of the floor includes a first shearwall and a second shearwall, wherein the first shearwall is generally perpendicular to the second shearwall.

18. The method of claim 12, wherein the floor comprises at least one tension tendon.

19. The method of claim 12, wherein the building comprises between 3 and 24 stories.

20. The method of claim 12, wherein a total floor area of each floor of said building is approximately 30,000 square feet.

* * * * *